United States Patent [19]

Grearson et al.

[11] 4,285,173

[45] Aug. 25, 1981

[54] BUILDING DECK STRUCTURE

[75] Inventors: Kenneth R. Grearson, Park Ridge; Robert Watson, Jr., Woodstock, both of Ill.

[73] Assignee: Multuloc Corporation, Chicago, Ill.

[21] Appl. No.: 107,033

[22] Filed: Dec. 26, 1979

[51] Int. Cl.[3] ..... E04C 2/26; E04C 2/32

[52] U.S. Cl. ..... 52/73; 52/250; 52/602; 52/326; 52/336

[58] Field of Search ..... 52/73, 94, 601, 602, 52/91, 55, 62, 371, 326, 250, 251, 252, 336, 814

[56] References Cited

U.S. PATENT DOCUMENTS

| | | | |
|---|---|---|---|
| 3,024,573 | 3/1962 | McKinley | 52/62 |
| 3,302,361 | 2/1967 | Oudheusden | 52/814 |
| 4,186,535 | 2/1980 | Morton | 52/795 |

*Primary Examiner*—John E. Murtagh
*Attorney, Agent, or Firm*—Thomas W. Speckman

[57] ABSTRACT

A poured concrete building deck structure of the type having corrugated sheet metal form deck wherein the edges along sides parallel to the corrugations of the major form deck at the edges of the deck and edges of internal openings through the deck are formed by a corrugated sheet metal form having corrugations at about 90° to the major portion of the corrugated sheet metal form deck, the ends of the deck around all sides of the building or around all sides of the internal opening being spaced a distance from the desired building line or opening and an edge bracket fastened to the outer ends of the sheet metal forms extending outwardly to the desired relationship to the building line or opening and providing a means to retain poured concrete.

18 Claims, 5 Drawing Figures

Fig. 1.
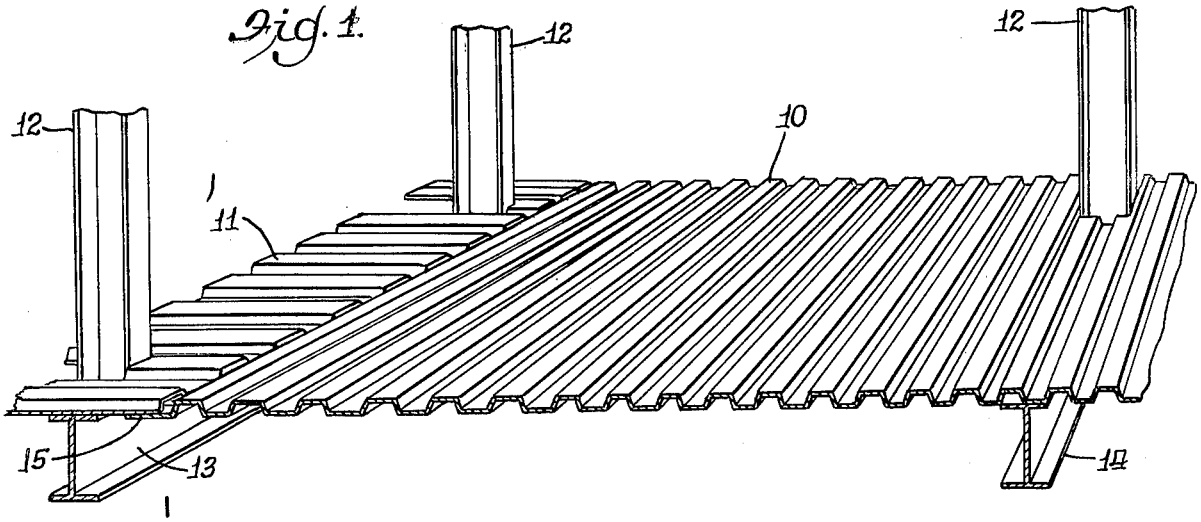
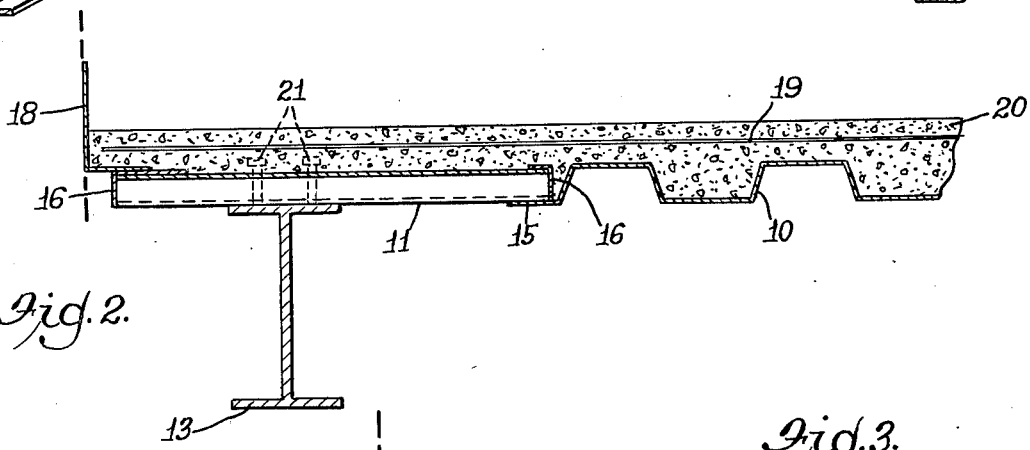
Fig. 2.
Fig. 3.
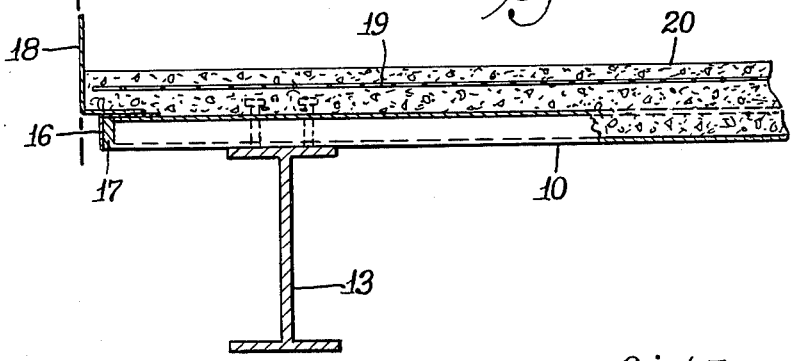
Fig. 4.
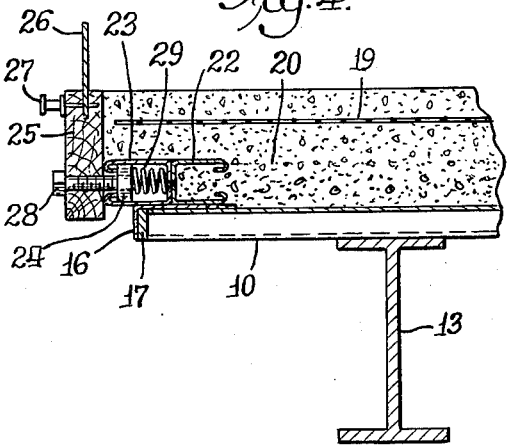
Fig. 5.
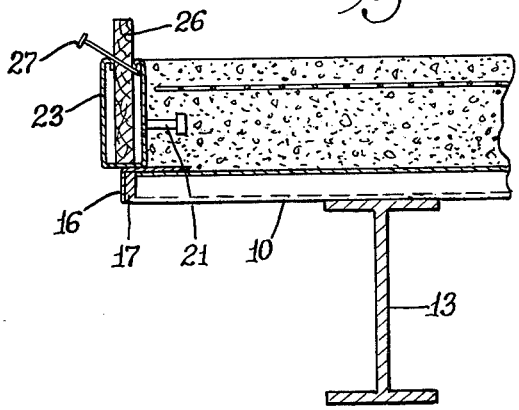

BUILDING DECK STRUCTURE

BACKGROUND OF THE INVENTION

1. Field of the Invention

This invention relates to poured concrete building deck structures which may perform the function of floors or roof decks. The concrete for the deck structure is poured over a corrugated sheet metal form deck which is supported by structural girders and spandrels. The improved building deck of this invention provides strength to the metal form deck at the sides which are normally parallel to the corrugations of the metal form deck and provides an adjustable edge bracket around four sides of the deck structure for easy and precise alignment with the desired building line. The same edge bracket configuration may be used on all four sides of the building or around interior openings and may be used to provide a toe rail during construction and to provide hanger receptacles for outer wall attachments.

2. Description of the Prior Art

In present day building construction, particularly of multi-story office buildings and industrial buildings, the decks are constructed by laying a deeply corrugated metal form deck structure over the horizontal structural girders and spandrels. Concrete is poured on top of the metal form deck structure, usually with reinforcing wire or mesh embedded therein to provide structural strength. Several problems are encountered in the construction of such concrete decks. One problem which arises is that when the corrugated metal form deck is placed over the horizontal metal girders and spandrels the edges of the deck parallel to the corrugations of the metal frequently extend beyond the spandrels and due to the flexibility of the metal deck, create a dangerous working situation and require structural bracing to support the edge of the metal form deck. The same problems exist at openings in the floors in the interior of the building, such as elevator shafts, stairways, and the like. Another problem which arises along the sides of the building parallel to the corrugations in the corrugated metal form deck is alignment of the edge of the deck with the desired building line, which cannot usually be measured from the spandrels beneath the deck since they are frequently not in the desired alignment. The same building line alignment problem exists at the sides of the building which are perpendicular to the corrugations of the metal form deck in that the ends of the metal pan must either be tediously aligned or cut with a torch to the exact building line requirement. Attempts have been made to solve these problems by use of L-shaped pans to provide desired stiffness to the edge of the metal deck and to provide an edge form for the concrete. Such pans must extend under the corrugated deck to rest on top of the spandrel and it is difficult to install the L-shaped pans precisely to form the desired building line. Further, such L-shaped pans must be installed from scaffolding from the floor beneath which, at the edge of the building, creates a particularly dangerous working condition.

SUMMARY OF THE INVENTION

This invention provides a poured concrete building deck structure having an improved edge construction wherein the edges parallel to the corrugations of a corrugated sheet metal form deck are spaced from the desired building line or opening and corrugated sheet metal form having corrugations at about 90° to the major portion of the corrugated sheet metal form deck is placed so that its inner end is supported by the edge open trough of the major corrugated sheet metal form deck and extends over a beam support in cantilever fashion, having its outer end which is perpendicular to the corrugations spaced a distance corresponding to the adjustability of an edge bracket from the desired building line or opening. An edge bracket is fastened to the outer end of the cantilevered form deck extending outwardly to the desired relationship to the building line or opening and upwardly to retain poured concrete. The same system may be used around interior openings such as for stairwells, columns and the like. The edge bracket serves as at least part of the end form for poured concrete and may provide anchoring for temporary toe boards and exterior wall systems.

Accordingly, it is an important object of this invention to provide an improved edge construction for poured concrete building deck structures which provides for easy alignment of exterior building lines or interior openings by adjustment of an edge bracket which may be readily applied from the upper surface of a corrugated sheet metal form deck.

It is another object of this invention to provide a manner of constructing a corrugated sheet metal form deck which provides a safe walking surface for workmen to its extreme edges, particularly at the edges of the building which are parallel to the corrugations of the major portion of the corrugated sheet metal form deck.

It is yet another object of this invention to provide a poured concrete building deck structure having a protective and readily removable toe board around the edges and all openings.

It is yet another object of this invention to provide a poured concrete building deck structure having a readily adjustable edge form system wherein the entire form may be removed and the exterior wall system attached to the same bracket as that holding the temporary form and toe board.

It is still another object of this invention to provide a corrugated metal form deck structure without the necessity of erection of scaffolding at the edge of the deck below to complete the form deck structure.

These and other objects, advantages and features of this invention will be apparent from the description by reference to the drawings wherein preferred embodiments are shown as:

FIG. 1 is a perspective view showing the corrugated metal form deck of one embodiment of this invention;

FIG. 2 is a sectional view of a poured concrete deck according to one embodiment of this invention showing the edge detail along the edge parallel to the corrugations of the major portion of the form deck;

FIG. 3 is a sectional view showing the edge detail at an edge at right angles to that shown in FIG. 2;

FIG. 4 is a sectional view of the edge detail of a deck of one embodiment of this invention showing a removable concrete form and toe board; and FIG. 5 is an edge detail of another embodiment of this invention showing a permanently in place concrete form with a removable toe board.

FIG. 1 shows a portion of major corrugated sheet metal form deck 10 supported by interior girder 14 terminating in corrugation trough 15 along its side parallel to the corrugations. Corrugated sheet metal form 11 is supported by corrugation trough 15 and extends over spandrel 13 in cantilever fashion having its outer end spaced a distance from the desired building line. Corrugated sheet metal form 11 is fastened to corrugation trough 15 by any suitable means such as screwing or spot welding and may be similarly fastened to spandrel 13. As seen in FIG. 1, the only open spaces requiring filling are those outwardly from columns 12. These spaces may be readily covered by strips of corrugated sheet metal form which may overlap at least one corrugation of corrugated metal form 11 on each side of the opening and be fastened thereto by screwing or spot welding.

The edge detail and poured concrete deck is best seen by reference to FIGS. 2 and 3. It is seen in FIG. 2 that the end of corrugated sheet metal form 11 and in FIG. 3, the end of sheet metal form deck 10 is spaced from the desired building line indicated by the dashed line. Edge bracket 18 is fastened to the outer end of the corrugated sheet metal form and extends outwardly to the desired relationship to the building line, or opening in the case of an interior opening through the deck, and upwardly to retain poured concrete. As shown in FIGS. 2 and 3, the edge bracket is a simple right angle shape. Concrete is retained from flowing out the ends of the corrugations by closure angle 16 located at both ends of the cantilevered sheet metal form and at the outer end of the major form deck. It is seen that edge bracket 18 may be readily adjusted to accurately meet building line requirements and fastened to the form deck with all operations necessary taking place from the surface of the form deck. In some cases it may be desirable to attached edge bracket 18 and closure angle 16 to the end of the form deck in a single prefabricated unit and closure pad 17, a resilient plastic pad fitting tightly into the corrugation troughs, may be provided to allow greater horizontal adjustment of edge bracket 18 while maintaining tight closure of the corrugation troughs to prevent leakage of wet concrete. As shown in FIGS. 2 and 3, edge bracket 18 is a right angle shape which extends above the surface of the concrete to provide a toe board as is required by many safety regulations. FIGS. 2 and 3 show stud shear connectors 21, reinforcing mesh 19 and poured concrete 20.

It is seen that all four sides of the building deck, or all four sides of an interior opening, have the same edge construction. Contrary to present construction practices, the corrugated sheet metal form deck is purposely spaced from the desired building line or the finished opening edge, a distance corresponding to the adjustability of the edge bracket to permit easy adjustment of the edge with a relatively lightweight and straight edge bracket.

FIG. 4 shows another embodiment of an edge bracket according to this invention. The edge bracket shown in FIG. 4 comprises two opposing U-shaped structures fastened together at their base and fastened to corrugated sheet metal form deck 10 along one side. U-shaped structure 23 serves as an attachment bracket for temporary form 25 and toe board 26. Form 25 may be fastened to attachment bracket 23 with bolt 28 screwing into nut 24 maintained in place by spring 29. The same manner of attachment may be used for building closure walls following removal of form 25 after setting of concrete 20. Form 25 may also be held in place by construction nails nailed into intermittent nailing blocks fitted within attachment bracket 23. Opposing anchor bracket 22 may be used in a similar fashion for providing anchors of any desired shape into concrete 20 or may be used without separate anchors as edge reinforcing for the concrete. This embodiment provides a continuous slot around the exterior at each floor level or around an interior opening for permanent wall attachment from the side.

The embodiment shown in FIG. 5 provides a continuous slot around the perimeter of a floor or around the perimeter of an interior opening for permanent wall attachment. The edge bracket shown in FIG. 5 comprises an upwardly extending U-shape having its bottom fastened in relation to the corrugated sheet metal and extending outwardly to the desired relationship to the building line or opening. As shown in FIG. 5, in one embodiment it is preferred that the top end of the legs of the U-shape are even with the height of the poured concrete. The height of the U-shape may, of course, be greater if desired. The open slot of the U-shape permits insertion of temporary toe rail 26 which may be securely held in place by nail 27. Likewise, the side of the U-shape may have stud shear connectors 21 fastened to it for greater composite action between the concrete and the edge bracket. As previously discussed, the attachment bracket 23 may be preassembled to closure angle 16 and the entire unit attached in one operation. Any suitable means for attachment of the permanent exterior wall, such as a curtain wall around the exterior of the building, or interior walls around an elevator shaft or stairwell at an interior opening, may be used. The example of the fastening as shown in FIG. 4 is solely for simplification of explanation and it is understood that any means for fastening the desired structure into the attachment bracket 23 shown in FIGS. 4 and 5, or to edge angle 18, as shown in FIGS. 2 and 3, may be used.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. In a poured concrete building deck structure of the type having a corrugated sheet metal form deck supported by structural girders and spandrels an improved edge construction along edges parallel to the corrugations of said form deck comprising:

an edge open trough of said corrugated sheet metal form deck being spaced from the desired building line or opening, a beam support between said edge open trough and said desired building line or opening;

a corrugated sheet metal form having corrugations at about 90° to the major portion of said corrugated sheet metal form deck having its inner end supported by said edge open trough of said corrugated sheet metal form deck and extending over said beam support in cantilever fashion and having its outer end which is perpendicular to its corrugations spaced a distance corresponding to the adjustability of an edge bracket from the desired building line or opening; and an edge bracket fastened to said outer end extending outwardly to the desired relationship to the building or opening and providing means to retain poured concrete.

2. The building deck structure of claim 1 wherein the outer open ends of corrugations of said corrugated sheet metal form are closed to retain poured concrete by a closure angle having one leg fastened to the top of the corrugated sheet metal form and the other leg extending downwardly adjacent said open ends in sufficiently close relationship to prevent passage of wet concrete.

3. The building deck structure of claim 1 wherein said edge bracket comprises an edge angle having one leg fastened in relation to said corrugated sheet metal form and extending outwardly to the desired relationship to the building line or opening, the other leg extending upwardly to retain poured concrete.

4. The building deck structure of claim 3 wherein said other leg extends upwardly beyond the level of concrete to be poured to serve as a toe rail at the edge of the deck or opening.

5. The building deck structure of claim 1 wherein said edge bracket comprises an upwardly extending U-shaped shape having its bottom fastened in relation to said corrugated sheet metal form and extending outwardly to the desired relationship to the building line or opening, the top end of the legs of said U-shaped form being a height to be even with the top of the concrete when poured.

6. The building deck structure of claim 5 wherein a temporary toe rail is provided by a flat board secured in the opening in said U-shaped shape and extending beyond the top end of the legs a desired distance.

7. The building deck structure of claim 1 wherein said edge bracket comprises two opposing U-shaped shapes fastened together at their bottoms and having one of their sides fastened in relation to said corrugated sheet metal form with one U-shape opening outwardly and the opposing U-shape opening inwardly, the open end of the outwardly opening U-shape extending outwardly to the desired relationship to the building line or opening and providing attachment means for a temporary formboard for the poured concrete.

8. The building deck structure of claim 7 wherein said outwardly extending U-shape provides means for anchoring for the building wall closure after removal of the formboard.

9. The building deck structure of claim 7 wherein the inwardly opening U-shape provides attachment means for concrete anchors.

10. A poured concrete building deck comprising:

a corrugated sheet metal form deck supported by structural girders and spandrels and comprising a major corrugated sheet metal form deck portion and two minor sheet metal form portions having corrugations at about 90° to the corrugations of said major deck portion, said major deck portion having its outer ends which are perpendicular to the corrugations spaced a distance corresponding to the adjustability of an edge bracket inside of the desired building line and its outer sides which are parallel to the corrugations spaced inside the spandrels, said minor form portions extending outwardly from each of said outer sides of said major deck portion over the spandrel and having their outer ends which are perpendicular to their corrugations a distance corresponding to the adjustability of an edge bracket inside of the desired building line and their inner ends supported by open troughs at each of said outer sides of said major deck portion;

edge brackets fastened to said major and minor corrugated metal form deck and forms outer ends, respectively, and outwardly to the desired building line and providing means to retain poured concrete to the desired height;

metal reinforcing above said metal deck and forms; and poured concrete adjacent and above said metal deck and forms embedding said metallic reinforcing and extending to said edge brackets to cover the desired concrete deck area.

11. The poured concrete building deck of claim 10 wherein the outer open ends of corrugations of said corrugated sheet metal forms and deck are closed to retain poured concrete by a closure angle having one leg fastened to the top of the corrugated sheet metal forms and deck and the other leg extending downwardly adjacent said open ends in sufficiently close relationship to prevent passage of wet concrete.

12. The poured concrete building deck of claim 10 wherein said edge bracket comprises an edge angle having one leg fastened in relation to said corrugated sheet metal forms and deck and extending outwardly to the desired relationship to the building line or opening, the other leg extending upwardly to retain poured concrete.

13. The poured concrete building deck of claim 12 wherein said other leg extends upwardly beyond the level of concrete to be poured to serve as a toe rail at the edge of the deck or opening.

14. The poured concrete building deck of claim 10 wherein said edge bracket comprises an upwardly extending U-shaped shape having its bottom fastened in relation to said corrugated sheet metal forms and deck and extending outwardly to the desired relationship to the building line or opening, the top end of the legs of said U-shaped form being a height to be even with the top of the concrete when poured.

15. The poured concrete building deck of claim 14 wherein a temporary toe rail is provided by a flat board secured in the opening in said U-shaped shape and extending beyond the top of the legs a desired distance.

16. The poured concrete building deck of claim 10 wherein said edge bracket comprises two opposing U-shaped shapes fastened together at their bottoms and having one of their sides fastened in relation to said corrugated sheet metal forms and deck one U-shape opening outwardly and the opposing U-shape opening inwardly, the open end of the outwardly opening U-shape extending outwardly to the desired relationship to the building line or opening and providing attachment means for a temporary formboard for the poured concrete.

17. The poured concrete building deck of claim 16 wherein said outwardly extending U-shape provides means for anchoring for the building wall closure after removal of the formboard.

18. The poured concrete building deck of claim 16 wherein the inwardly opening U-shape provides attachment means for concrete anchors.

* * * * *